US008132740B2

(12) United States Patent
Maev et al.

(10) Patent No.: US 8,132,740 B2
(45) Date of Patent: Mar. 13, 2012

(54) GAS DYNAMIC SPRAY GUN

(75) Inventors: Roman Gr. Maev, Windsor (CA); Volf Leshchynsky, Windsor (CA); Emil E. Strumban, Oak Park, MI (US)

(73) Assignee: Tessonics Corporation, Birmingham, MI (US)

( * ) Notice: Subject to any disclaimer, the term of this patent is extended or adjusted under 35 U.S.C. 154(b) by 1339 days.

(21) Appl. No.: 11/328,792

(22) Filed: Jan. 10, 2006

(65) Prior Publication Data

US 2007/0160769 A1 Jul. 12, 2007

(51) Int. Cl.
*B05B 1/24* (2006.01)

(52) U.S. Cl. ..... 239/135; 239/344; 239/418

(58) Field of Classification Search ..... 239/135, 239/67–69, 71, 344, 361, 418, 417.5, 426, 239/433; 250/356.1, 33
See application file for complete search history.

(56) References Cited

U.S. PATENT DOCUMENTS

| | | | | |
|---|---|---|---|---|
| 3,100,724 | A | | 8/1963 | Rocheville |
| 3,501,097 | A | | 3/1970 | Daley et al. |
| 3,618,828 | A | | 11/1971 | Schinella |
| 3,958,758 | A | * | 5/1976 | Piorkowski ..... 239/133 |
| 3,976,332 | A | | 8/1976 | Fabel |
| 4,381,898 | A | | 5/1983 | Rotolico et al. |
| 4,740,112 | A | | 4/1988 | Muehlberger et al. |
| 4,808,042 | A | | 2/1989 | Muehlberger et al. |
| 4,941,778 | A | * | 7/1990 | Lehmann ..... 406/28 |
| 5,047,612 | A | * | 9/1991 | Savkar et al. ..... 219/121.47 |
| 5,302,414 | A | | 4/1994 | Alkhimov et al. |
| 5,795,626 | A | | 8/1998 | Gabel et al. |
| 6,139,913 | A | | 10/2000 | Van Steenkiste et al. |
| 6,273,789 | B1 | * | 8/2001 | LaSalle et al. ..... 451/38 |
| 6,283,386 | B1 | | 9/2001 | Van Steenkiste et al. |
| 6,364,932 | B1 | | 4/2002 | Ji et al. |
| 6,402,050 | B1 | | 6/2002 | Kashirin et al. |
| 6,502,767 | B2 | | 1/2003 | Kay et al. |
| 6,623,796 | B1 | | 9/2003 | Van Steenkiste |
| 6,715,640 | B2 | | 4/2004 | Tapphorn et al. |
| 6,722,584 | B2 | | 4/2004 | Kay et al. |
| 6,811,812 | B2 | | 11/2004 | Van Steenkiste |
| 2003/0219542 | A1 | | 11/2003 | Ewasyshyn et al. |

* cited by examiner

*Primary Examiner* — Davis Hwu
(74) *Attorney, Agent, or Firm* — Carlson, Gaskey & Olds, PC

(57) ABSTRACT

A portable gas dynamic cold spray gun eliminates many of the inherent limitations of the prior art by minimizing a scatter of operating parameters and improving its efficiency. According to one feature of the present invention, the powder flow rate is continuously measured so that the powder flow rate and/or the flow rate of the pressurized gas can be adjusted accordingly in order to control the deposition efficiency of the spray gun.

26 Claims, 3 Drawing Sheets

GAS DYNAMIC SPRAY GUN

BACKGROUND OF THE INVENTION

This invention relates to a portable gas dynamic spray gun for cold gas dynamic spraying of a metal, alloy, polymer or mechanical mixtures thereof.

Gas dynamic spray guns coat substrates by conveying powder particles in a carrier gas at high velocities and impacting the substrate to form the coating. The gas and particles are formed into a supersonic jet having a temperature below the fusing temperature of the powder material, and the jet is directed against an article to be coated.

One difficulty associated with some of the prior art spray systems is that the powder is injected into the heated main gas stream prior to passage through the nozzle. The powder has a tendency to plug a throat of nozzle to result in backpressure and attendant malfunction of the gun. This requires a complete shutdown of the system and cleaning of the nozzle. Larger particles tend to plug the nozzle even more.

The second difficulty is associated with low durability of the convergent and throat portions of nozzle. Because the heated main gas stream is under high-pressure, the injection of the powder also requires high-pressure powder delivery systems, which are quite expensive and would be difficult to use in a portable cold spray gun.

Some known spray guns use a powder feeding system having an enclosed hopper for containing powder in loose particulate form. A carrier gas conduit connected to a carrier gas supply extends through the hopper in its lower portion and continues to a point of powder-carrier gas utilization. Fluidizing gas in a regulated amount is supplied to the hopper and the flow of the fluidizing gas is regulated by sensing the pressure at a point in a carrier gas line, which pressure is responsive to the mass flow rate of solids, and then using the change in the pressure in the conveying gas line, if any, to regulate the flow of the fluidizing gas. This type of system has certain problems with control and uniformity of the powder feed rate. One such problem is pulsation, apparently due to a pressure oscillation, resulting in uneven coating layers.

Another problem with some of the known spray guns relates to the heating unit for heating the carrier gas prior to the nozzle. Generally, the heating unit is either too large to be used in a portable spray gun, or it is too small to heat the carrier gas sufficiently.

SUMMARY OF THE INVENTION

A portable gas dynamic cold spray gun according to the present invention eliminates many of the inherent limitations of the prior art spray guns by minimizing the scatter of operating parameters and improving its efficiency. According to one feature of the present invention, the powder flow rate is continuously measured so that the powder flow rate and/or the flow rate of the pressurized gas can be adjusted accordingly in order to control and improve the deposition efficiency of the spray gun.

The spray gun generally includes a gas passageway through the spray gun. A gas supply port supplies pressurized air (or other gas) to the inlet of the passageway. A nozzle in the passageway forms the pressurized air into a supersonic jet stream. A powder feed passage leads to the passageway and supplies powder at a controlled rate to the passageway, where it is entrained in the gas and exits the spray gun in the supersonic jet stream.

The spray gun further includes a powder flow rate sensor that measures the powder flow rate of the powder. In the example spray gun described herein, the powder flow rate sensor includes a light emitter transmitting light across a duct through which the powder travels. A light receiver mounted opposite the light emitter determines the flow rate of the powder based upon the amount of light received from the light emitter. A controller adjusts the gas flow rate and/or the powder flow rate based upon the measured powder flow rate and based upon a set powder flow rate or a stored desired powder flow rate.

BRIEF DESCRIPTION OF THE DRAWINGS

Other advantages of the present invention can be understood by reference to the following detailed description when considered in connection with the accompanying drawings wherein.

DETAILED DESCRIPTION OF THE PREFERRED EMBODIMENTS

Figure 1:
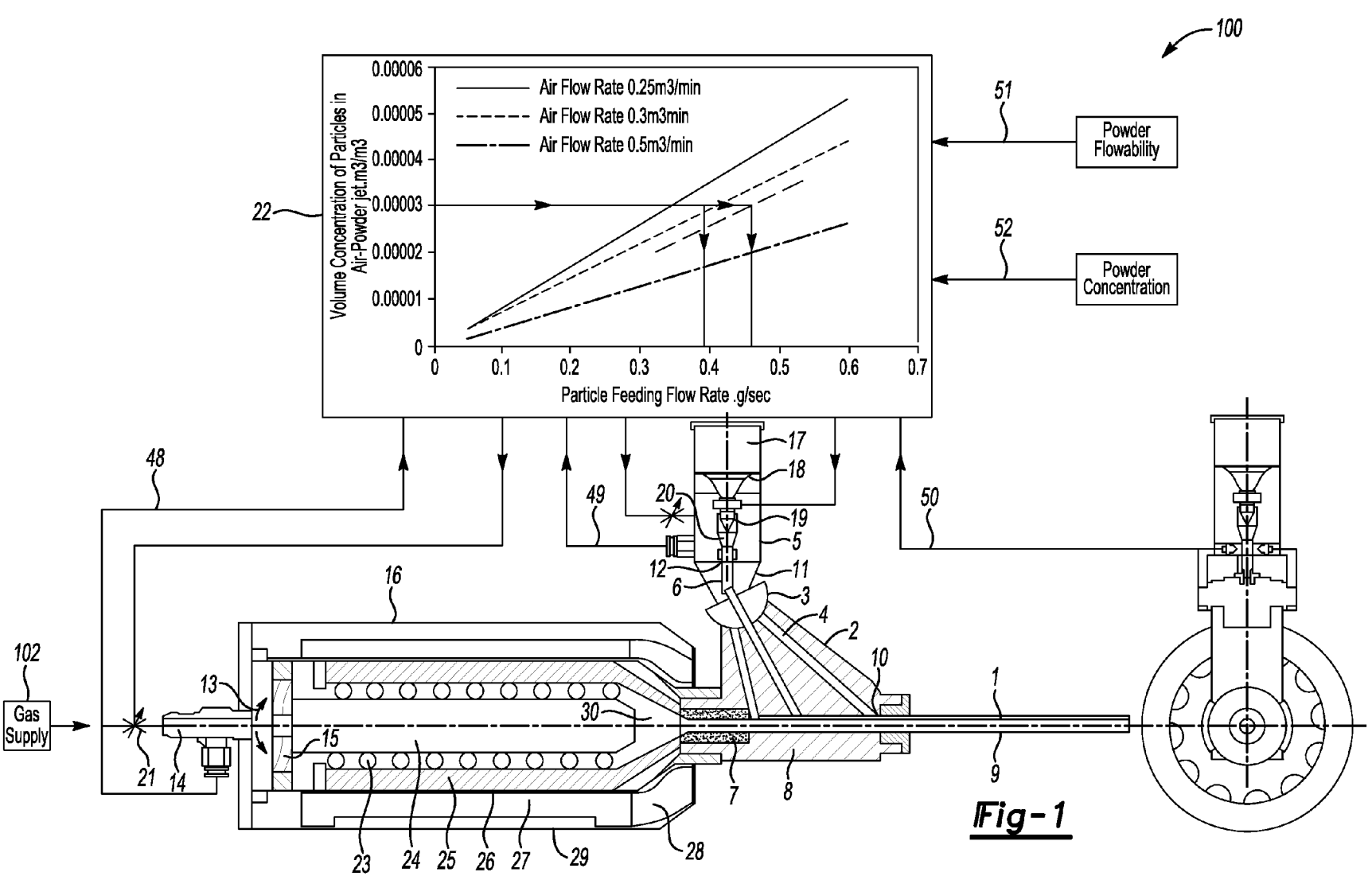
FIG. 1 is the front and side views, partially in cross-section, of a portable gas-dynamic spray gun.

A portable gas dynamic spray (GDS) gun 100 according to the present invention is shown in FIG. 1. The GDS gun 100 generally includes a pressurized gas source 102 supplying high-pressure air or other gas to a heat chamber 16. A ceramic insert 7 leads from the heat chamber 16 and forms the throat and part of the converging portion of a nozzle. A steel tube 9 leading from the ceramic insert 7 forms the diverging portion of the nozzle. The tube 9 extends through an outer housing 2 from which it is supplied with powder 17 from a container 18. Generally, as the pressurized air or other gas passes through the nozzle, it reaches supersonic velocities and draws powder 17 from the container 18 into the tube 9.

The outer housing 2 has multiple passages 4 therethrough each leading to axially-spaced orifices 10 on the tube 9. A rotatable switch 3 selectively supplies powder to one of the multiple passages 4 in the outer housing 2 based upon the value of negative pressure at certain points of the air jet. The rotatable switch 3 may be set manually, or automatically by the controller 22 based upon expected negative pressure points along the tube 9. Depending upon the pressure from pressurized gas source 102, the location along the tube 9 of a negative pressure point may vary. The rotatable switch 3 should be set so that the selected orifice 10 coincides with the negative pressure point.

The powder container 18 feeds powder 17 to the switch 3 through a vibrating bowl 19, funnel 20 and a powder-aspirating duct 6 into the partial-vacuum powder passages 4 of the outer housing 2. The powder 17 then mixes with the jet of conveyance air and then jointly with it flows through the duct 1 of the nozzle to impart supersonic velocities to the air and entrained powder.

A jet of conveyance air 13 from pressurized air supply 102 is supplied via a compressed-air line 14 through a guide vane 15 to be heated in the heat chamber 16. The compressed-air line 14 contains a variable throttle 21 by which the flow impedance (e.g. the flow cross-section) is regulated from a controller 22 as a function of a setpoint value of the volumetric flow of conveyance air and/or of a setpoint value for the volume concentration of the particles in powder laden jet. The controller 22 may be a computer having a processor, memory and other storage, and being suitably programmed to perform the operations described herein.

The heat chamber 16 includes a serpentine or helical coil heating element 23 mounted on a ceramic support 24 and an insulation chamber 25, which is located in an internal chamber housing 26. The second insulation sleeve 27 with insulation cup 28 is arranged in outer chamber housing 29. The air 13 flows along the helical path defined by the helical coil heating element 23, the ceramic support 24 and the insulation chamber 25. The heated air exits the heater via tapered chamber 30, which together with ceramic insert 7 forms the convergent portion of the nozzle.

Figure 2A:
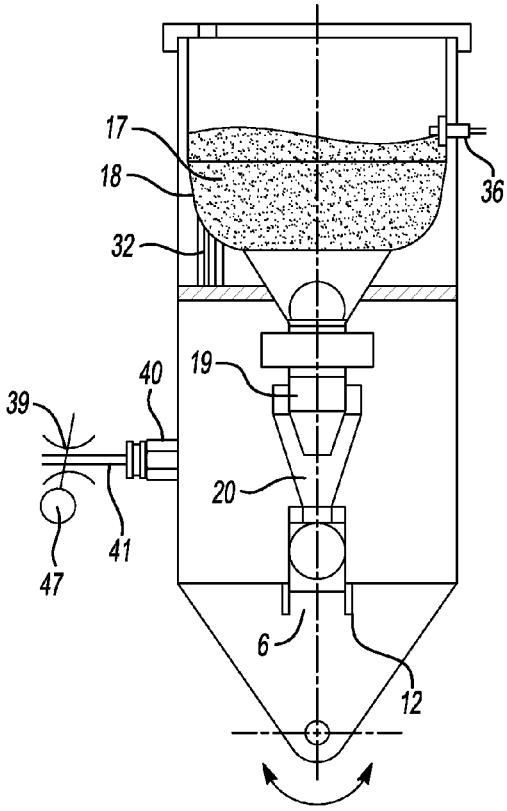
FIG. 2A is a front view, shown in partial cross-section, of a powder pickup device used in the spray gun shown in FIG. 1.
Figure 2B:
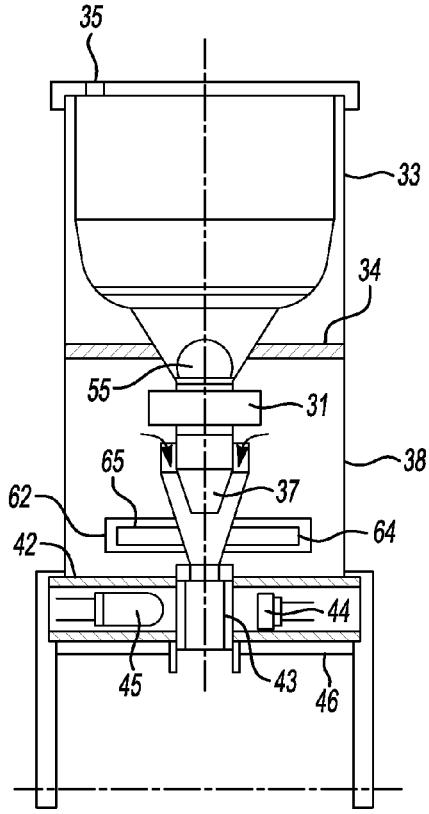
FIG. 2B is a side view of the powder pickup device of FIG. 2A.

The powder supply system is shown in more detail in FIGS. 2A and 2B. The powder supply system includes the powder container 18 enclosing a powder 17 to be sprayed in loose particulate form, a bowl vibration unit 31 (such as a motorized vibration unit) for control of the powder flow rate, and the funnel 20 connected to the powder aspirating duct 6 and a flexible hose 12. Additionally, a powder container vibration unit 32 is incorporated into the upper portion of powder supply system. The vibration unit 32 is installed on a baffle plate 34 supporting the container 18. Simultaneous control of the two vibration units 31, 32 provides precise and constant control of the powder feeding rate.

Figure 3A:
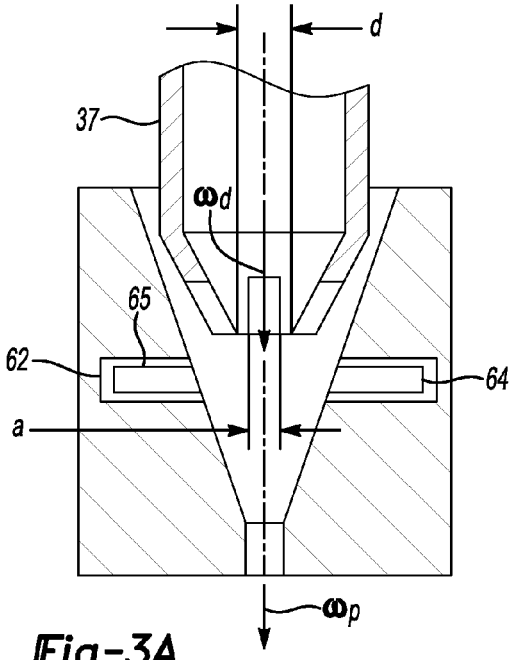
FIG. 3A is a fragmentary longitudinal cross-section view of a portion of a powder supply vibrating bowl of FIGS. 2A and 2B.
Figure 3B:
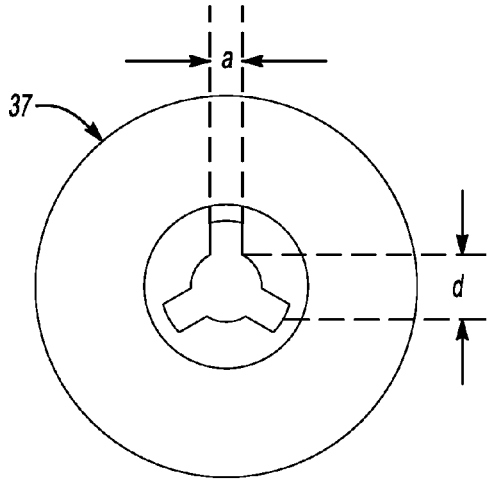
FIG. 3B is a bottom view of the bowl nose of FIG. 3A.

Powder is fed into the powder container 18 through a port 35 so that a certain level of powder 17 is maintained by a sensor 36 which controls an operation of a main powder hopper (not shown). Referring to FIGS. 3A and 3B, the rate of dispensing powder (powder flow rate) is additionally controlled by the removable bowl 19 nose 37 with a diameter d of hole and size a of slots. The rate of dispensing powder 17 is defined by flowability of the powder 17. The hole has a diameter d with slots of width a creating channels along the hole. The diameter d of the hole is preferably approximately three times the width a of the slots. The diameter d is preferably approximately ten to twenty times the particle diameter. The shape and dimensions of the opening in the bowl nose 37 make the flow more controllable based upon adjustments in the vibration. The bowl nose 37 can be replaced with holes and slots of different sizes when used with different particle sizes.

The partial vacuum existing in the partial-vacuum zone in the lower portion of pick-up housing 38 aspirates air from the atmosphere while being strongly throttled by the flow throttle 39 when passing into the partial-vacuum zone of chamber 38. The chamber 38 is fitted with a flow sensor 40 generating a measurement signal in the signal line 49 as a function of the air flowing from the atmosphere through the throttle 39 into the partial-vacuum zone of chamber 38, i.e. the quantity per unit time, or rate, of air passing through the throttle 39 and passage 41 and hence also being a control of the rate of powder passing through the powder passage 4.

The pick-up device comprises a powder metering unit 42 detecting a flow of powder particles in a measurement duct, which in the embodiment shown is a glass powder transportation tube 43 connecting the funnel 20 to the powder aspirating duct 6 attached to the powder switch 3. The powder-metering unit 42 includes an infrared sensor 44 and an infrared emitter or light source 45 disposed within the channel made in pick-up bottom plate 46. The infrared sensor 44 can determine the mass flow of powder 17 through the glass tube 43 based upon the amount of light from light source 45 that is able to pass through the glass tube 43 to the infrared sensor 44. Although an infrared light source 45 and infrared sensor 44 are preferred, other wavelengths of light or other waves could also be used.

Optionally, an additional powder metering unit 62 can be mounted in the pick up housing 38 on opposite sides of the funnel 20. The powder metering unit 62 is preferably similar to the power metering unit 42 and includes an infrared sensor 64 (or light sensor) and an infrared emitter 65 (or light source). This powder metering unit 62 measures the powder dispensing rate $\omega_d$ from the vibrating bowl 19. The powder dispensing rate $\omega_d$ can then be compared to the conveyed powder rate $\omega_p$. The amplitudes of the vibration units 31, 32 can be adjusted relative to one another in order to ensure that the powder dispensing rate $\omega_d$ is equal (over some short period of time) to conveyed powder rate $\omega_p$. This prevents clogging of the funnel 20.

The particle volume concentration significantly affects the deposition efficiency. The particle volume concentration in a powder laden jet greatly influences the effectiveness of GDS process particularly in the case of radial injection of powder by conveyance air of the partial-vacuum zone. In the preferred embodiment, the control of volume concentration of particles is achieved by regulation of two parameters: a rate of conveyed powder and a rate of conveyance air. The rate of conveyed powder $\omega_p$ is substantially dependent on the powder dispensing rate $\omega_d$ and the rate of conveyance air. The powder rate is approximately proportional to the rate of conveyance air of the partial-vacuum zone of chamber 38. Therefore, the conveyance air must be adjusted to adjust a desired particle volume concentration of powder laden jet. Thereupon the controller 22 will automatically set the rate of conveyance air by means of the adjustment motor 47 and the throttle 39 in such a way that the volumetric flow shall remain at the setpoint. From an other side the controller 22 will automatically set the powder dispensing rate $\omega_d$ by means of the adjustment of amplitudes of vibration units 31, 32 on the basis of measurements of the rate of conveyed powder $\omega_p$ in order to achieve the permanent balance $\omega_d=\omega_p$. Additionally the rate of conveyance air is regulated by a change of an injection point location by the switch 3 manually or automatically.

The controller 22 regulates the powder feeding flow rate, carrier air 13 flow rate and feed of powder conveyance air in the partial-vacuum zone of chamber 38 as a function of the measurement signals of the measurement lines 48, 49,50 and as a function of the setpoint value of the volume concentration of particles in air-powder jet by means of the vibration units 31, 32 and the throttles 21, 39.

The controller 22 comprises an input 51 for the powder flowability setpoint value receiving a manual or automatic fixed or variable setpoint of the powder dispensing flow rate "$\omega_d$" to be conveyed, for instance in g/sec, and an input 52 for volume concentration of powder setpoint value "$C_v$" allowing to determine the carrier air flow rate for the air passing through the powder/air duct 1 from an equation $$C_V = \frac{\omega_p}{\rho_p \cdot \omega_{air}}$$

where $\omega_p$ is the particle feeding flow rate from the funnel 20 (FIG. 2), $\rho_p$ is the material density and $\omega_{air}$ is the carrier air flow rate controlled by air pressure and throttle 21 (a graph on controller 22).

Figure 4A:
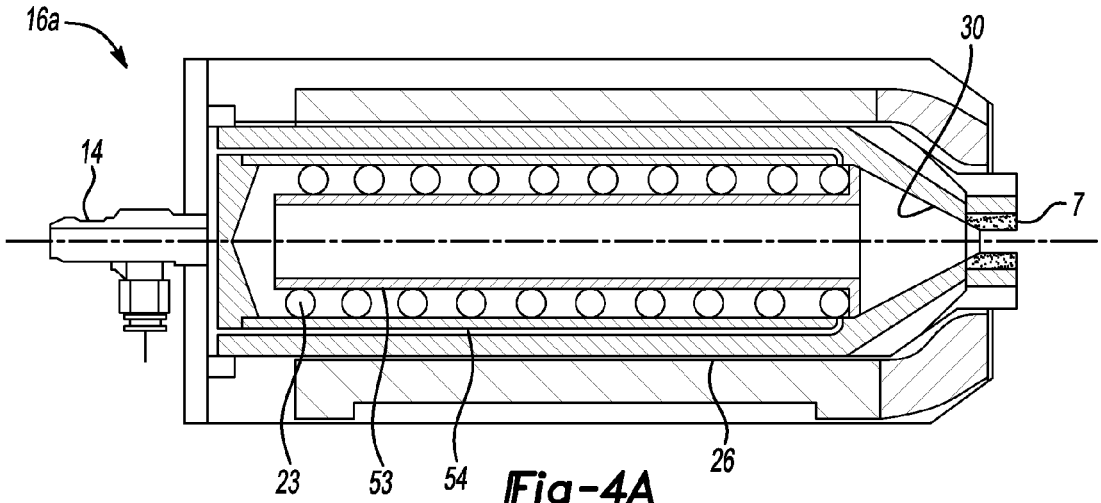
FIG. 4A is a cross-section of an alternative heating chamber that could be used in the spray gun of FIG. 1.

An alternative heat chamber 16*a* is shown in FIG. 4A. The heat chamber 16*a* includes the helical coil-heating element 23 mounted on a ceramic tube 53 within a carrier air transportation pipeline 54. The carrier air transportation pipeline 54 is mounted inside the internal chamber housing 26 to define a hollow cylindrical passageway therebetween. The air flows in from the line 14 forwardly (to the right in FIG. 4A) between the internal chamber housing 26 and the pipeline 54. The air then enters the forward end of pipeline 54 and flows rearwardly within the helical coil-heating element 23. At the rearward end of the pipeline 54, the air enters the ceramic tube 53 and then travels forwardly through the ceramic tube 53 the tapered chamber 30 and the converging ceramic insert 7. Thus, the air gathers heat from the helical coil-heating element 23 on three serpentine passes. This increase in the heating surface intensifies the heating of the air and increases the temperature of carrier air up to 650-850° C. in the portable heating chamber. The system incorporates safety features for the protection of both the system and the operator. The control system 22 (FIG. 1) switches off the power supply and sends a signal out in case of abnormal increase in the temperature of the gas above a set value.

Figure 4B:
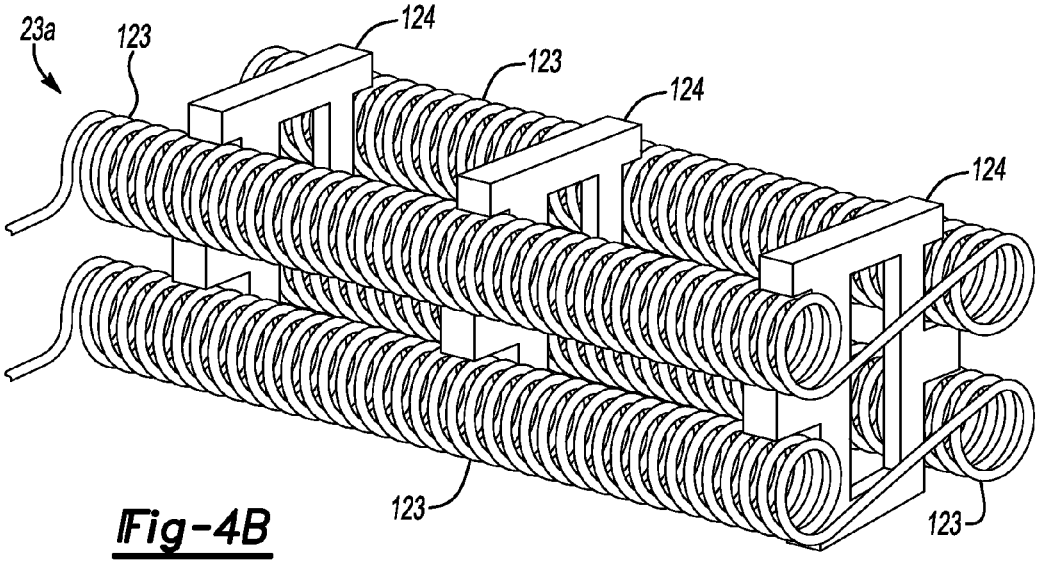
FIG. 4B is a perspective view of another alternative heating unit that could be used in the spray gun of FIG. 1.
Figure 4C:
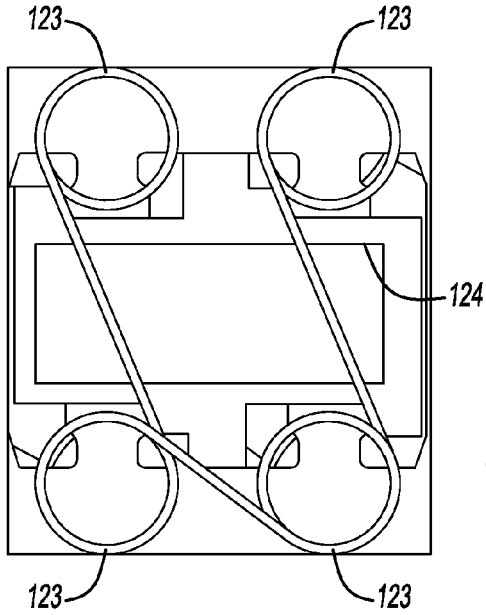
FIG. 4C is an end view of the heating unit of FIG. 4B.

An alternative heating element 23*a* is shown in FIG. 4B, generally including a plurality of coils 123 connected to one another in series and spaced about a passageway by supports 124.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope. Alphanumeric identifiers on method steps are provided for ease of reference in dependent claims and are not intended to dictate a particular sequence for performance of the method steps unless otherwise indicated in the claims.

What is claimed is:

1. A method for controlling a cold spray gun including the steps of:

a) flowing powder into a stream of conveyance air;

b) measuring a powder flow rate of the powder;

c) adjusting at least one of a flow rate of the conveyance air and the powder flow rate based upon the measured powder flow rate of the powder; and d) forming a supersonic jet of the conveyance air and the powder, the supersonic jet having a temperature below a fusing temperature of the powder, said step d) including the step of directing the conveyance air through a nozzle of the gun, wherein the conveyance air travels along a straight path from the nozzle to an exit of the gun;

wherein said step a) includes introducing the powder into the stream of conveyance air downstream of the nozzle.

2. The method of claim 1 wherein said step b) is performed by passing a wave through the flow of powder.

3. The method of claim 1 wherein said step b) is performed by passing light through the flow of the powder.

4. The method of claim 3 wherein said step b) further includes measuring light that passes through the flow of the powder.

5. The method of claim 1 wherein said step a) further includes the step of flowing the powder through a measurement duct and wherein said step b) further includes the step of transmitting light through the measurement duct.

6. The method of claim 5 wherein said step c) includes the step of adjusting the flow rate of the conveyance air.

7. The method of claim 5 wherein the step of adjusting in said step c) is also based upon a set powder flow rate.

8. The method of claim 1 further including the step of directing the supersonic jet against an article to be coated.

9. The method of claim 1 wherein the conveyance air and powder travel within a metal tube from a point where the powder is introduced to the conveyance air to the exit of the gun.

10. A cold spray gun comprising:

a gas supply port;

a passageway leading from the gas supply port, the passageway including a nozzle having a converging portion and a tube leading to ambient;

a bowl receiving powder from a powder container;

a powder container vibration unit vibrating the powder container;

a bowl vibration unit vibrating the bowl;

a powder feed passage between the bowl and the tube, the powder feed passage leading into the tube;

a powder flow rate sensor measuring a powder flow rate of powder, wherein the powder flow rate sensor is positioned to measure the powder flow rate of powder prior to the passageway; and a controller for controlling the powder container vibration unit and the bowl vibration unit based upon information from the powder flow rate sensor.

11. The cold spray gun of claim 10 wherein the powder flow rate sensor includes a light emitter and a light receiver.

12. The cold spray gun of claim 11 wherein the light emitter is an infrared emitter.

13. The cold spray gun of claim 12 wherein the powder flows through a measurement duct, the light emitter transmitting light through the measurement duct, the light receiver receiving the light transmitted through the measurement duct.

14. The cold spray gun of claim 11 wherein the powder flow rate sensor further includes a dispensing nose and an axially opposite funnel having a partial vacuum therebetween for aspirating powder through the dispensing nose, the light emitter and the light receiver transmitting light through the partial vacuum to the light receiver to measure the powder flow rate.

15. The cold spray gun of claim 10 wherein the nozzle includes a converging section and a diverging section and the powder feed passage leads to the passageway downstream of the converging section.

16. The cold spray gun of claim 15 wherein the powder feed passage is one of a plurality of powder feed passages leading to axially-spaced points along the passageway.

17. The cold spray gun of claim 16 further including a switch for selectively directing the powder into one of the plurality of powder feed passages.

18. The cold spray gun of claim 17 further including a heater between the gas supply port and the nozzle.

19. The cold spray gun of claim 18 wherein the heater includes a helical path through which the gas flows along a heating element.

20. The cold spray gun of claim 18 wherein the heater includes a serpentine path from a rearward area to a forward area back through the forward area.

21. The cold spray gun of claim 20 further including a controller adjusting at least one of a flow rate of conveyance gas through the gas supply port and the powder flow rate based upon the measured flow rate of the powder.

22. The cold spray gun of claim 10 wherein the powder container and bowl are within a housing, the cold spray gun including an air flow sensor adjacent an air inlet into the housing, the controller controlling the powder container vibration unit and the bowl vibration unit based upon information from the air flow sensor.

23. The cold spray gun of claim 10 wherein the nozzle generates a conveyance air at a supersonic rate at a temperature below a fusing temperature of the powder.

24. A cold spray gun comprising:

a nozzle having a converging portion and a diverging portion;

a gas heater connected to the nozzle;

a pressurized gas source for injecting a gas into the nozzle through the gas heater;

a powder feeder for feeding a powder into the diverging portion of the nozzle, the powder feeder including at least one vibrator;

a dispensing nose and an axially opposite funnel having a partial-vacuum zone therebetween between for the purpose of aspirating powder out of a powder source;

a sensor and a light source measuring powder feed rate from the funnel; and a controller regulating a flow of the gas into the nozzle based upon the measured powder feed rate, the controller regulating the at least one vibrator to control the powder feed rate.

25. The portable cold spray gun of claim 24 wherein the nozzle includes a ceramic converging throat insert and the diverging portion is affixed to an outer housing.

26. The portable cold spray gun of claim 24 wherein the diverging portion includes a plurality of powder injection orifices connected to a plurality of powder passages.

* * * * *